United States Patent [19]

Prepodnik et al.

[11] Patent Number: 4,519,219

[45] Date of Patent: May 28, 1985

[54] RECEPTACLE FOR BEVERAGE CONTAINER

[75] Inventors: Kay E. Prepodnik, Milwaukee; Peter A. Finn, Wauwatosa; Daniel J. Manning, Thiensville, all of Wis.

[73] Assignee: The Kelch Corp., Mequon, Wis.

[21] Appl. No.: 522,809

[22] Filed: Aug. 15, 1983

[51] Int. Cl.[3] ..... F25D 3/06

[52] U.S. Cl. ..... 62/457; 62/463; 62/464; 220/411; 220/413; 220/428; 206/519

[58] Field of Search ..... 62/457, 371, 372, 529, 62/463, 464; 220/410, 411, 412, 413, 408, 428; 206/519

[56] References Cited

U.S. PATENT DOCUMENTS

| | | | |
|---|---|---|---|
| 1,868,773 | 7/1932 | Staake | 215/12 R |
| 2,358,450 | 9/1944 | Foley | 62/463 X |
| 2,921,706 | 1/1960 | Johnson | 215/12 R |
| 3,373,580 | 3/1968 | Federishi | 62/457 X |
| 3,622,036 | 11/1971 | Bongaerts | 220/70 |
| 3,765,559 | 10/1973 | Sauey et al. | 62/457 |
| 3,804,281 | 4/1974 | Eckdahl . | |
| 4,042,142 | 8/1977 | Ruano | 62/372 X |
| 4,164,853 | 8/1979 | McDonough | 62/457 |
| 4,255,944 | 3/1981 | Gardner | 62/371 X |
| 4,296,728 | 10/1981 | Hofstetter | 220/469 X |
| 4,431,326 | 2/1984 | Braithwaite et al. | 220/70 X |

OTHER PUBLICATIONS

P. 84 of the C&H "Buyers Guide Catalog 833" dated 1983, Showing the Huskies Batch Cans.

*Primary Examiner*—Allan N. Shoap
*Attorney, Agent, or Firm*—Quarles & Brady

[57] ABSTRACT

A receptacle for holding a beverage container such as a beer keg while the exterior of the container is being subjected to a cold liquid is disclosed. In one embodiment, there is a plastic housing which is formed with a generally cup-shaped internal cavity, the cavity having a bottom cavity wall and cavity sidewalls. The housing is also formed with an opening for allowing the container and the cold liquid to be inserted in and removed from the cavity. A plurality of ribs are positioned in the cavity that have an inner centering edge which is spaced radially inward from the cavity sidewalls. The inner edges are suitable to hold the container away from the sidewalls when the container is inserted in the cavity and positioned radially inward of the inner edge. In another preferred form, there is also provided a platform positioned in the cavity and affixed to the bottom wall. It has an upper edge which is spaced upward from the cavity bottom wall so that when the container and cold liquid are inserted in the cavity and the container is positioned over the upper edge, the upper edge can hold the container off the bottom cavity wall.

2 Claims, 7 Drawing Figures

Fig. 1
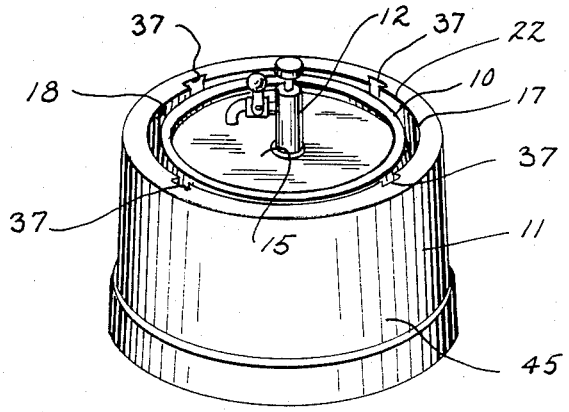
Fig. 3
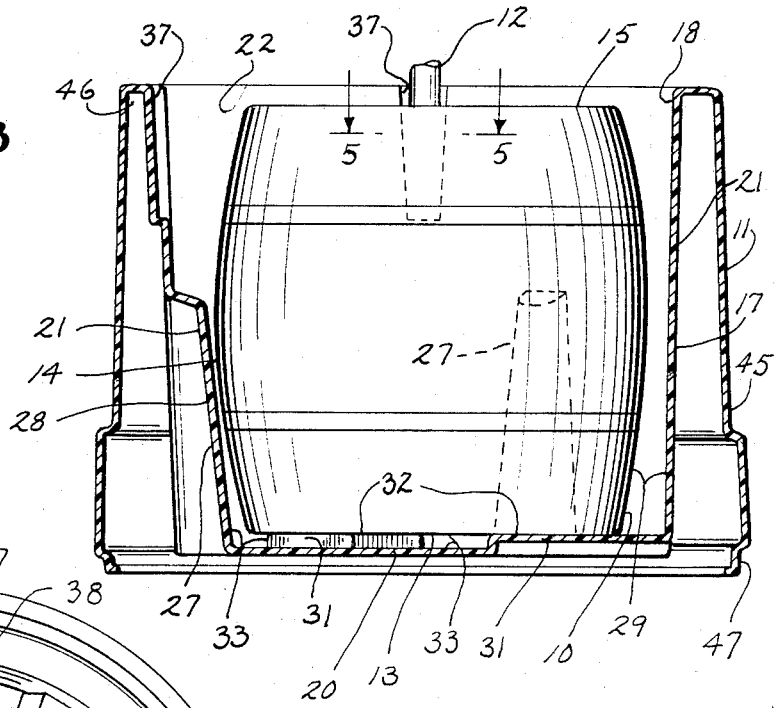
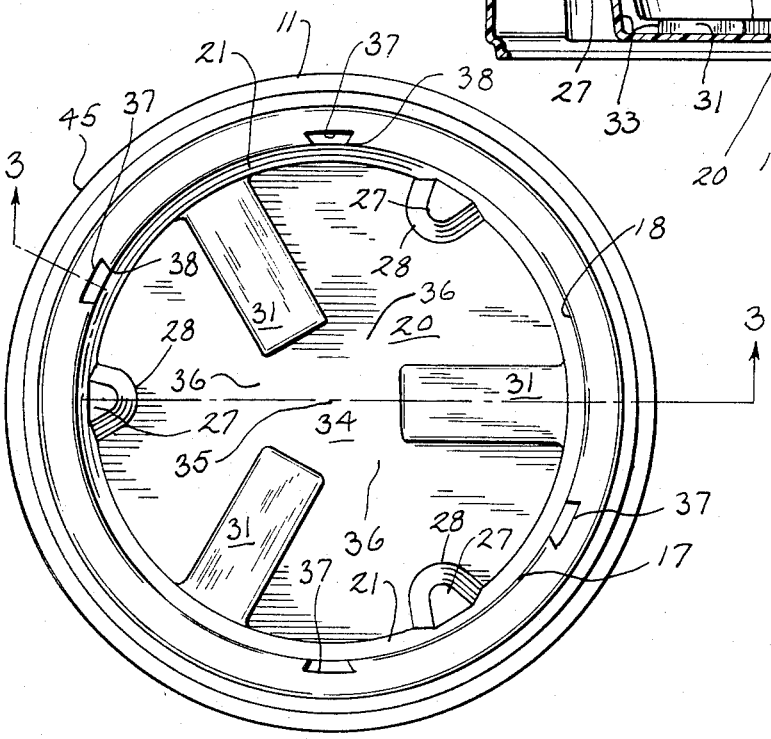
Fig. 2

Fig. 4
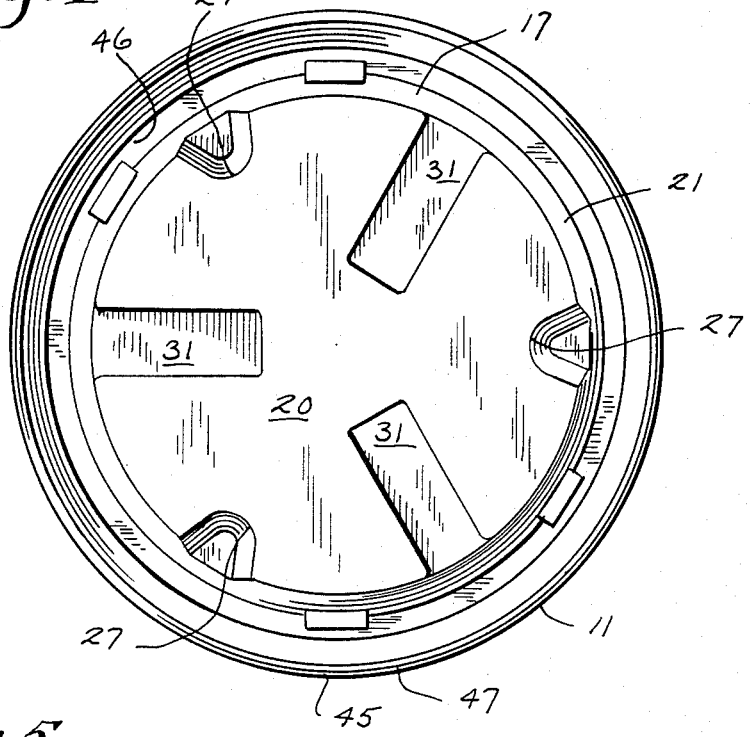
Fig. 5
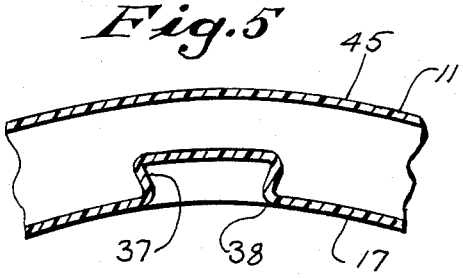
Fig. 7
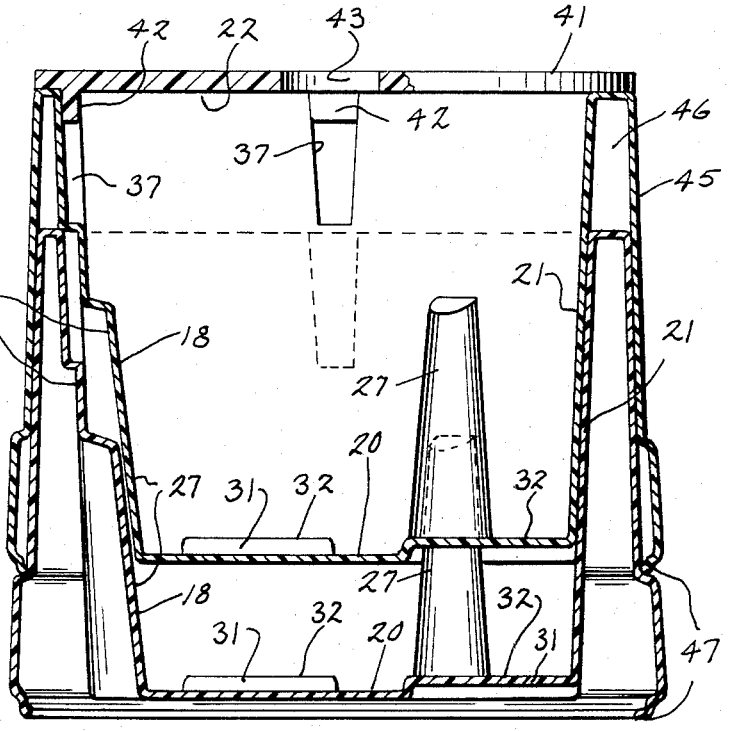
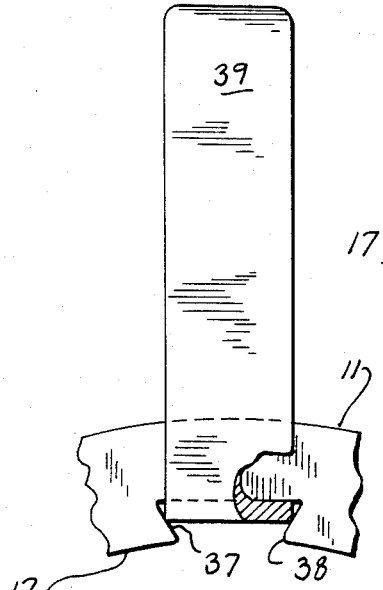
Fig. 6

RECEPTACLE FOR BEVERAGE CONTAINER

BACKGROUND OF THE INVENTION

A. Field of the Invention

This invention relates to an improved receptacle for keeping the contents of a beer keg (or other similar large beverage container) cold at locations where electrical refrigeration is not available.

B. Description of the Art

It is very common for beverages to be purchased in large, generally cylindrical containers such as kegs and jugs. While the beverage stored in such containers can be kept chilled by electric refrigerators, this type of refrigeration is usually not available at outdoor locations such as parks and beaches. The possibility of cooling off certain beverages with an ice cube in the drink is not a practical alternative for beer (and some other drinks) because most individuals dislike the taste of watered down beer. For this reason, some individuals have resorted to using garbage cans or large wash tubs to create makeshift ice baths for the kegs or jugs. Such ice baths are of some value, but they suffer from a number of problems. First, because they are single walled metal receptacles, they are very bad insulators. The ice in the bath can quickly melt on hot summer days, and the temperature of the ice bath and beer (or other beverage) can rise as a result.

Further, when the container is fairly full, it is often in direct contact with the bottom of the tub, which in turn can be in direct contact with the ground. On a hot sandy beach the heat from the ground can be transmitted through the metal bottom of the tub to the bottom of the container. This problem is made much worse because many beer kegs are designed so that the beer which is about to be delivered from the keg is drawn off only from the bottom of the keg.

Another problem can occur if the container drifts towards a side wall of the ice bath. If this occurs, in addition to the fact that the container will not be fully surrounded by cold water, one side of the container may be in contact with a metal surface. This creates yet another inefficiency.

Another problem with these makeshift receptacles is that when the keg or other container is nearly empty, it may float and then tip on its side. This can cause contamination of the beer tap unit if the tap tips into the unsanitary ice water.

It can therefore be seen that a need has existed for an improved way of chilling beverage containers such as beer kegs at sites where electrical refrigeration equipment is not available.

SUMMARY OF THE INVENTION

The present invention relates to a receptacle for holding a beverage container while the exterior of the container is being subjected to a cold liquid. There is provided a housing which is formed with a generally cup-shaped internal cavity. The cavity is defined by a bottom wall and cavity sidewalls. The housing also has an opening for allowing the container and the cold liquid to be inserted in and removed from the cavity.

In accordance with the invention, a centering means is positioned in the cavity. The centering means has an inner centering edge which is spaced radially inward from a cavity side wall so that the inner edge can hold the container away from the sidewall when the container is inserted in the cavity in a position radially inward of the inner edge. Preferably, the centering means is a series of vertical ribs which are formed as part of the cavity sidewalls, and these ribs are circumferentially spaced around the radial periphery of the cavity.

In another aspect of the invention, there is a platform positioned in the cavity which has an upper edge that is spaced upward from the cavity bottom wall. When a container and cold liquid are inserted in the cavity, and the container is positioned over the upper edge, the upper edge can hold the container up off the cavity bottom wall, while allowing some of the liquid to be stored between the cavity bottom wall and a bottom side of the container. Perferably, the platform is affixed to the cavity bottom wall and is formed so as not to cover a portion of the bottom wall adjacent a central vertical axis of the cavity.

In another aspect of the invention, an outer insulating tube is formed integrally with the housing. The tube surrounds the cavity sidewalls so as to leave a space between the inside of the tube and a substantial portion of the cavity sidewalls. If desired, the outer insulating tube can be formed so as to extend below the housing. When this is done, the tube forms a pedestal to hold the receptacle up off the ground.

One or more recesses can be formed in the upper end of the cavity side walls so as to provide positive stops when the receptacles are nested in one another. The recesses can also be used to position a top cover, or to retain support brackets for a table.

The present invention therefore provides a receptacle in which a beer keg or other large beverage container can be positioned while it is being chilled. The keg is held up off the bottom wall of the ice bath and away from the sides. The ice water can therefore surround the sides and bottom of the keg. For maximum chilling effect ice water can reach a point directly under the middle of the keg bottom.

The insulating tube which surrounds the ice bath allows the ice bath to maintain its temperature by creating a second wall and an air gap between the walls. Further, because the tube also forms a pedestal for the housing, the bottom wall of the housing cavity is held up off the hot ground. Through use of the vertical ribs, the receptacle can prevent tipping of the keg even when it is almost empty.

The objects of the invention therefore include:

(a) providing a receptacle of the above kind which allows ice water to surround the bottom and sidewalls of the beverage container;

(b) providing a receptacle of the above kind which minimizes the amount of environmental heat which can reach the beverage container;

(c) providing a receptacle of the above kind which is nestable within another such receptacle for easy storage and transport;

(d) providing a receptacle of the above kind which prevents tipping of the keg in the receptacle;

(e) providing a receptacle of the above kind which is relatively inexpensive to produce, and which is highly durable and impact resistant; and (f) providing a receptacle of the above kind which can support a table top.

These and other objects and advantages of the invention will be apparent from the description which follows. In the description, reference shall be made to the accompanying drawings which form a part hereof and in which there is shown by way of illustration preferred embodiments of the invention. Such embodiments do not represent the full scope of the invention. Rather the invention may be employed in other embodiments.

BRIEF DESCRIPTION OF THE DRAWINGS

FIG. 1 is a perspective view of a receptacle embodying the present invention in which has been placed a beer keg;

FIG. 2 is a top plan view of the receptacle of FIG. 1;

FIG. 3 is a sectional view taken on line 3—3 in FIG. 2;

FIG. 4 is a bottom plan view of the receptacle of FIG. 1;

FIG. 5 is a sectional view taken on line 5—5 in FIG. 3;

FIG. 6 is a top plan view of a portion of the top rim of the receptacle of FIG. 1, with a support bracket inserted in one of the vertical grooves; and FIG. 7 is a view similar to FIG. 3, but showing how the receptacles are nestable within one another.

DESCRIPTION OF THE PREFERRED EMBODIMENT

Referring now to FIG. 1, there is shown a beer keg 10 which has been placed into a receptacle 11. Such kegs are usually made of metal or a non-insulating plastic, and the receptacle of the present invention is formed from a durable insulating plastic such as polyethylene. The keg 10 has the usual tap 12 at its top which extends upward out of the receptacle 11. The tap 12 is connected to an internal keg delivery system (not shown) which extends downward into the keg 10 almost all the way to the bottom of the keg. Thus, beer is drawn off from the bottom of the keg. The keg 10 has a fairly flat bottom 13, gently bulging vertical sides 14, and a generally flat top 15.

In accordance with the present invention, the receptacle 11 has a generally cylindrical housing 17. The housing 17 is formed with a cup-shaped internal cavity 18 defined by a bottom cavity wall 20 and cavity sidewalls 21. The housing 17 is also formed with an upward opening 22 for allowing the keg 10 and ice water to be easily inserted and removed from the cavity 18.

From examining FIG. 2 it will be noted that there are three internal vertical ribs or centering means 27 formed on the sidewalls 21. The ribs 27 each have an inner centering edge 28 which is spaced radially inward from the cavity sidewalls 21. The ribs 27 are circumferentially spaced around the radial periphery of the cavity 18, and they extend substantially parallel to the cavity sidewalls 21.

Ribs 27 are perferably integrally formed with the cavity sidewalls 21 during molding, and they are dimensioned such that the keg 10 will fit radially inward of the inner edges 28 as shown in FIG. 3. In this manner, the inner edges 28 of the ribs 27 hold the keg 10 away from the sidewalls 21 when the keg 10 is inserted in the cavity 18. (See gap 29 in FIG. 3.)

Platforms 31 are formed at the bottom of the cavity 18, and have an upper edge 32 which is spaced upward from the cavity bottom wall 20. When the keg 10 and the ice water are inserted in the cavity 18, and the keg 10 is positioned over the upper edge 32 of the platform 31 as shown in FIG. 3, the upper edge 32 holds the keg 10 up off the bottom wall 20, while allowing some of the water 23 to be stored between the cavity bottom wall 20 and the bottom wall 13 of the keg. (See gap 33 in FIG. 3.)

Platforms 31 can be formed integrally with the cavity bottom wall 20 during molding, and are positioned relative to the bottom wall 20 so as not to cover a portion 34 of the bottom wall 20 adjacent the central vertical axis 35 of the cavity 18 (see FIG. 2). Access gaps 36 between the platforms 31 provide a passageway for water to flow under the bottom of the keg.

The cavity also has four vertical recesses or slots 37 at its top end. Each of these recesses tapers towards the center of the ice bath as at point 38 of FIG. 5. The slots are suitable for at least three purposes.

As shown in FIG. 6, the slots 37 can hold support brackets 39 that extend outward of the circumference of the receptacle 11. These brackets 39 can then be used to support semi-circular or circular doughnut tables (not shown) that surround the receptacle 11, and are suitable to hold beer cups, napkins and the like.

As an alternative, a disc shaped receptacle cover 41 (see FIG. 7) can be used. The cover 41 has legs 42 that fit in the slots 37. A central hole 43 in the cover allows the tap 12 to project through the cover 41, but the cover is positioned over most of the top wall 15 of the keg 10.

The back side of the back wall of slots 37 can also provide a positive stop for the nesting of the receptacles as shown in FIG. 7.

As can be seen best in FIG. 2, the sidewalls 21 of the cavity 18 slope inward and away from an insulating tube 45. There is therefore a space 46 between the inside of the tube 45 and a portion of the cavity sidewalls 21. This is an air gap for insulation purposes. It also should be noted that the tube 45 can be made to extend below the housing 17, so that it forms a pedestal 47 which holds the housing 17 up off the ground.

Another feature of the invention is that the vertical ribs 27 are formed so as to prevent the keg 10 from tipping even when the keg 10 becomes slightly buoyant. In this regard, the diameter of a conventional keg is only slightly less than that of a cylinder defined by the centering edges 28, the platforms 31, and the opening 22.

It will be readily apparent to those skilled in the art that a number of modifications and changes may be made to the preferred embodiments without departing from the spirit and scope of the invention. For example, instead of using vertical ribs which are integrally formed with the side walls of the cavity, the centering means might instead be a series of columns or other structures projecting upward from the bottom of the cavity. Also, rather than having a platform which is integral with the bottom wall of the cavity, the platform might be an extension from the side walls of the receptacle. While the keg shown in the drawings has gently rounded vertical sides, it should be apparent that other keg and jug configurations are suitable for use with this invention. The scope of the invention should therefore not be limited solely by the description of the preferred embodiment.

We claim:

1. A receptacle for holding a beer keg while the exterior of the keg is being subjected to an ice water bath, comprising:

a housing which is formed with a generally cup-shaped internal cavity, the cavity being defined by a bottom wall and cavity sidewalls;

the housing also being formed with an upper opening for allowing the keg and ice water to be inserted in and removed from the cavity;

a plurality of vertically extending centering ribs positioned in the cavity at circumferentially spaced locations around the radial periphery of the cavity;

said ribs having inner centering edges spaced radially inward from the cavity sidewalls;

side compartments which are bounded by adjacent ribs, the cavity sidewalls and upon insertion of the keg the keg outer side walls, and which are suitable for storing the ice water along the sides of the keg;

a platform positioned in the cavity and having an upper edge which is spaced upward from the cavity bottom wall, so that when the keg and ice water are inserted in the cavity and the keg is positioned on the upper edge, the upper edge can hold the keg up off the cavity bottom wall;

said platform being constructed so as not to cover a portion of the cavity bottom wall adjacent a central vertical axis of the cavity;

a bottom compartment adjacent the central vertical axis of the cavity which is bounded by the bottom wall of the cavity, the platform, and upon insertion of the keg the bottom of the keg, for storing ice water under the keg;

said side compartments being in direct communication with said bottom compartment when the keg has been positioned on the platform, whereby the ice water may readily pass therebetween once it is added to the cavity; and a pocket formed in the upper end of a cavity side wall, said pocket being upwardly open, having a bottom closure, and having means defining pocket sides, whereby a support post may be mounted in said pocket and held by said pocket against other than substantially vertical movement.

2. A receptacle for holding a beer keg while the exterior of the keg is being subjected to an ice water bath, comprising:

a housing which is formed with a generally cup-shaped internal cavity, the cavity being defined by a bottom wall and cavity sidewalls;

the housing also being formed with an upper opening for allowing the keg and ice water to be inserted in and removed from the cavity;

an outer insulating housing tube being formed integrally with the internal cavity, said tube surrounding the cavity sidewalls, and being positioned relative thereto so as to leave a space between the inside of the tube and a portion of the cavity sidewalls, said tube also extending below the bottom of the cavity bottom wall to form a pedestal support for the cavity;

a plurality of vertically extending centering ribs positioned in the cavity at circumferentially spaced locations around the radial periphery of the cavity;

said ribs having inner centering edges spaced radially inward from the cavity sidewalls;

side compartments which are bounded by adjacent ribs, the cavity sidewalls and upon insertion of the keg the keg outer side walls, and which are suitable for storing the ice water along the sides of the keg;

a platform positioned in the cavity and having an upper edge which is spaced upward from the cavity bottom wall, so that when the keg and ice water are inserted in the cavity and the keg is positioned on the upper edge, the upper edge can hold the keg up off the cavity bottom wall;

said platform being constructed so as not to cover a portion of the cavity bottom wall adjacent a central vertical axis of the cavity and to have a plurality of segments which radiate outwardly towards the cavity sidewalls;

a bottom compartment adjacent the central vertical axis of the cavity which is bounded by the bottom wall of the cavity, the platform, and upon insertion of the keg the bottom of the keg, for storing ice water under the keg;

said ribs and radiating platform segments being angularly offset from each other at a plurality of locations around the periphery of the cavity side walls; and said housing being a one-piece unit made of molded thermoplastic, and being of substantially uniform thickness throughout.

* * * * *